US009587636B2

(12) United States Patent
Poole et al.

(10) Patent No.: US 9,587,636 B2
(45) Date of Patent: Mar. 7, 2017

(54) METHOD AND SYSTEM FOR MONITORING THE OPERATIONAL STATE OF A PUMP

(71) Applicant: Airbus Operations GmbH, Hamburg (DE)

(72) Inventors: Kevin Poole, Hamburg (DE); Frank Thielecke, Buxtehude (DE)

(73) Assignee: Airbus Operations GmbH, Hamburg (DE)

( * ) Notice: Subject to any disclaimer, the term of this patent is extended or adjusted under 35 U.S.C. 154(b) by 125 days.

(21) Appl. No.: 14/227,443

(22) Filed: Mar. 27, 2014

(65) Prior Publication Data

US 2014/0318235 A1 Oct. 30, 2014

Related U.S. Application Data

(63) Continuation of application No. PCT/EP2012/004082, filed on Sep. 28, 2012.

(60) Provisional application No. 61/540,019, filed on Sep. 28, 2011.

(51) Int. Cl.

| | |
|---|---|
| ***G01L 7/20*** | (2006.01) |
| ***G01L 5/14*** | (2006.01) |
| ***F04B 51/00*** | (2006.01) |
| ***F04B 49/06*** | (2006.01) |
| ***F04B 49/08*** | (2006.01) |

(52) U.S. Cl.

CPC ..... *F04B 51/00* (2013.01); *F04B 49/065* (2013.01); *F04B 49/08* (2013.01); *F04B 2205/05* (2013.01); *F04B 2205/09* (2013.01)

(58) Field of Classification Search

CPC .... F04B 49/065; F04B 49/08; F04B 27/1804; F04B 49/002; F04B 51/00; E02F 9/2296; F04D 15/0088; F04D 13/086; F04D 13/12

USPC ..... 73/212, 213, 229, 448, 168, 114.42

See application file for complete search history.

(56) References Cited

U.S. PATENT DOCUMENTS

| | | | | |
|---|---|---|---|---|
| 4,541,274 A * | 9/1985 | Purcupile | ..... | E21B 47/0008 166/105 |
| 6,857,474 B2 * | 2/2005 | Bramlett | ..... | E21B 47/0008 166/250.15 |
| 7,500,390 B2 * | 3/2009 | Mills | ..... | E21B 47/0008 73/152.61 |

(Continued)

FOREIGN PATENT DOCUMENTS

| | | |
|---|---|---|
| DE | 10157143 | 5/2003 |
| DE | 102008063924 | 6/2009 |

OTHER PUBLICATIONS

International Search Report, Jun. 12, 2013

*Primary Examiner* — Eric S McCall
*Assistant Examiner* — Mohammed E Keramet-Amircolai
(74) *Attorney, Agent, or Firm* — Greer, Burns & Crain Ltd.

(57) ABSTRACT

A method and a system for monitoring the operational state of a pump including acquiring a set characteristic diagram of the pump, the characteristic diagram of the pump being defined by a functional relationship between a first pump operating parameter characteristic of the operational state of the pump and a second pump operating parameter characteristic of the operational state of the pump. Subsequently, an actual characteristic diagram of the pump is acquired when the pump is installed in a higher-level system, in particular an aircraft system, and is running. Finally, the actual characteristic diagram of the pump is compared with the set characteristic diagram of the pump.

16 Claims, 4 Drawing Sheets

(56) References Cited

U.S. PATENT DOCUMENTS

| | | | | |
|---|---|---|---|---|
| 2003/0144818 | A1* | 7/2003 | Kasuya | F04B 23/06 702/185 |
| 2003/0194326 | A1 | 10/2003 | Bettenhausen et al. | |
| 2005/0109698 | A1* | 5/2005 | Gerhardt | G01F 1/363 210/656 |
| 2006/0078435 | A1* | 4/2006 | Burza | F04B 49/065 417/279 |
| 2007/0151333 | A1* | 7/2007 | Paradise | F01D 17/08 73/114.35 |
| 2008/0131290 | A1* | 6/2008 | Magoon | F04B 13/00 417/38 |
| 2008/0245136 | A1* | 10/2008 | Gerhardt | B01L 3/50273 73/61.56 |
| 2008/0264155 | A1* | 10/2008 | Achleitner | F02D 41/221 73/114.42 |
| 2009/0196767 | A1* | 8/2009 | Peters | B66C 23/42 417/212 |
| 2009/0269213 | A1* | 10/2009 | Anderson | F04B 49/002 417/212 |
| 2010/0100404 | A1* | 4/2010 | Hodges | B01J 19/002 705/7.31 |
| 2011/0010075 | A1* | 1/2011 | Rogers | F02D 19/0631 701/103 |
| 2014/0199183 | A1* | 7/2014 | Taravat | F04B 17/03 417/63 |

* cited by examiner

METHOD AND SYSTEM FOR MONITORING THE OPERATIONAL STATE OF A PUMP

CROSS-REFERENCES TO RELATED APPLICATIONS

This application is a continuation of International Application PCT/EP2012/004082 filed Sep. 28, 2012, designating the United States and published on Apr. 4, 2013 as WO 2013/04102. This application also claims the benefit of the U.S. Provisional Application No. 61/540,0196, filed on Sep. 28, 2011, and of the German patent application No. 10 2011 115 244.3 filed on Sep. 28, 2011, the entire disclosures of which are incorporated herein by way of reference.

BACKGROUND OF THE INVENTION

The invention relates to a method and a system for monitoring the operational state of a pump.

In modern aircraft, a large number of pumps are installed. For example, in the various central hydraulic systems present on board an aircraft and used, inter alia, for supplying the landing gear actuating device or the control surfaces of the primary flight controls, pumps are usually employed to convey hydraulic fluid through the lines of the hydraulic systems. Moreover, cooling systems, employed for cooling heat-loaded aircraft components, air conditioning systems, water supply systems and other aircraft systems may also be equipped with pumps. At present, pumps employed in aircraft are usually tested for faults on special test stands, and where necessary repaired, exclusively in the dismounted state according to methods specified by the manufacturer. However, a pump is generally dismounted and checked only if a faulty operation or even a system failure has already been detected for the system equipped with the pump. A faulty operation or a failure of a relevant aircraft system, however, generally requires immediate and thus not plannable checking and where necessary repair of the system. This may result in disruptions to the service of the aircraft, in particular flight delays or flight cancellations and thus increased costs.

SUMMARY OF THE INVENTION

The invention is directed at the object of specifying a method and a system which enable a monitoring of the operational state of a pump when the pump is installed in a higher-level system, for example a hydraulic system of an aircraft system, and is running.

In the case of a method according to the invention for monitoring the operational state of a pump, first of all a set characteristic diagram of the pump is acquired. The characteristic diagram of the pump is defined by a functional relationship between a first pump operating parameter characteristic of the operational state of the pump and a second pump operating parameter characteristic of the operational state of the pump. The set characteristic diagram of the pump defines the operating performance of the pump, i.e., the functional relationship between the first pump operating parameter characteristic of the operational state of the pump and the second pump operating parameter characteristic of the operational state of the pump when the pump is intact and functioning properly.

The set characteristic diagram may be prescribed by the manufacturer of the pump or ascertained from a maintenance manual or the like. Alternatively to this, it is also possible to measure the set characteristic diagram of the pump. For this purpose, with the pump intact, for a plurality of values of the first pump operating parameter characteristic of the operational state of the pump, the associated values of the second pump operating parameter characteristic of the operational state of the pump are determined, or for a plurality of values of the second pump operating parameter characteristic of the operational state of the pump, the associated values of the first pump operating parameter characteristic of the operational state of the pump are determined. The set characteristic diagram of the pump then results from the pairs of values, assigned to one another, of the first and of the second pump operating parameter. The measurement of the set characteristic diagram of the pump may be performed on a special test stand when the pump is not installed, but also when the pump is already installed in a higher-level system. All that is essential is that a proper functioning of the pump is ensured during determination of the set characteristic diagram.

In a further step of the method for monitoring the operational state of a pump, an actual characteristic diagram of the pump is acquired when the pump is installed in a higher-level system, in particular an aircraft system, and is running. To create the actual characteristic diagram, use is made in particular of those pump operating parameters which are characteristic of the operational state of the pump and have also been used to create the set characteristic diagram of the pump. Since the pump operating parameters used to create the set characteristic diagram and the actual characteristic diagram of the pump are parameters which are characteristic of the operational state of the pump, i.e., of the operational reliability of the pump, the functional relationship between the two pump operating parameters also changes if the operational reliability of the pump deteriorates, for example due to wear or the like. Consequently, in the event of a deterioration of the operational reliability of the pump, there results a deviation of the actual characteristic from the desired characteristic of the pump.

In the method according to the invention for monitoring the operational state of a pump, the actual characteristic diagram of the pump which has been acquired when the pump is running is therefore compared with the set characteristic diagram of the pump. This comparison enables conclusions to be drawn regarding the operational state, i.e., the operational reliability of the pump. The comparison of the actual characteristic diagram with the set characteristic diagram of the pump may be performed manually. For example, it is conceivable to output the two characteristic diagrams in a graphical representation on a display and then manually assess this graphical representation. Alternatively to this, however, it is also conceivable to automate the characteristic diagram comparison, for example, by means of a preferably electronic control unit. If a predetermined threshold value for the deviation of the actual characteristic diagram from the set characteristic diagram is exceeded, provision may be made for a warning signal or the like to be output.

The method according to the invention enables an assessment of the operational state, i.e., the operational reliability, of the pump when it is installed and running. It is therefore no longer necessary to dismount the pump in order to check its operational reliability. Moreover, the method can be realized comparatively simply, without complex sensor technology and signal processing. If the pump monitored by means of the method according to the invention is installed in an aircraft system, for example a hydraulic system of an aircraft, reductions of the operational reliability of the pump can be detected in good time and system failures thereby avoided. A repair or an exchange of the pump can be better planned, thereby making it possible to minimize disruptions to the service of the aircraft due to maintenance work on the pump.

Preferably, the characteristic diagram of the pump is defined by a functional relationship between an outlet volume flow of the pump and an outlet pressure of the pump. These two pump operating parameters are particularly suitable for creating the characteristic diagrams, since a change of the operational state, i.e., the operational reliability, of the pump has immediate effects on their functional relationship. For example, an increase of an internal leakage of the pump, for example due to wear, at a constant outlet volume flow, results in a reduction of the outlet pressure of the pump. A degradation of the pump operational state can therefore be reproduced particularly well by the above-described set/actual characteristic diagram comparison. Moreover, changes of the functional relationship between the outlet volume flow and the outlet pressure of the pump have immediate effects on the operation of a higher-level system in which the pump is installed. The information about the operational state of the pump obtained from the above-described set/actual characteristic diagram comparison thus allows immediate conclusions to be drawn regarding the operating performance of the higher-level system.

The outlet volume flow of the pump is preferably acquired by a flow sensor. In principle, the flow sensor may be a flow sensor which is permanently installed in the region of an outlet of the pump. Alternatively to this, however, it is also conceivable to use a flow sensor which is not permanently installed, i.e., a non-invasive flow sensor, for detecting the outlet volume flow of the pump, which sensor is arranged in the region of the pump outlet temporarily, i.e., only to acquire the set and/or actual characteristic diagram of the pump. The flow sensor may be, for example, an ultrasonic sensor. The outlet pressure of the pump is preferably acquired by a pressure sensor. In particular, use is made of a pressure sensor which is present anyway in the higher-level system downstream of the pump. It is thereby possible to dispense with the installation of a separate sensor.

Preferably, the actual characteristic diagram of the pump is compared with the set characteristic diagram of the pump, for at least one predetermined value of the first or of the second pump operating parameter characteristic of the operational state of the pump. Selecting a predetermined value of the first or of the second pump operating parameter characteristic of the operational state of the pump facilitates the set/actual characteristic diagram comparison. The predetermined value of the first or of the second pump operating parameter characteristic of the operational state of the pump may be characteristic for example of a standard operation of the pump. A standard operation of the pump is understood here to mean a normal-load operation of the pump which occurs frequently during the operation of the pump. A set/actual characteristic diagram comparison at this value of the first or of the second pump operating parameter characteristic of the operational state of the pump then readily enables conclusions to be drawn regarding the operating performance of the pump in the standard operation. Alternatively or additionally to this, a value of the first or of the second pump operating parameter characteristic of the operational state of the pump may also be used for the set/actual characteristic diagram comparison which is characteristic of a high-load operation of the pump. In the operation of the pump, a high-load operation usually occurs less frequently than a standard operation, but a degradation of the operational state of the pump is usually particularly clearly apparent in the high-load operation.

In one embodiment of the method for monitoring the operational state of a pump, periodically or continuously, for at least one predetermined value of the first pump operating parameter characteristic of the operational state of the pump, a difference between a value of the second pump operating parameter characteristic of the operational state of the pump, which is assigned to the predetermined value of the first pump operating parameter characteristic of the operational state of the pump on the actual characteristic diagram of the pump and a value of the second pump operating parameter characteristic of the operational state of the pump, which is assigned to the predetermined value of the first pump operating parameter characteristic of the operational state of the pump on the set characteristic diagram of the pump may be obtained. In other words, at particular time intervals or continuously, for a predetermined value of the first pump operating parameter, a difference between the actual value assigned to this value and the set value assigned to this value of the second pump operating parameter is obtained. Depending on whether this difference is positive or negative, it can then be established whether the operational state of the pump is still at the desired level or not. Preferably, a progression over time of this difference is also acquired, so that it is possible to observe the evolution over time of the operational state of the pump.

Alternatively or additionally to this, periodically or continuously, for at least one predetermined value of the second pump operating parameter characteristic of the operational state of the pump, a difference between a value of the first pump operating parameter characteristic of the operational state of the pump, which is assigned to the predetermined value of the second pump operating parameter characteristic of the operational state of the pump on the actual characteristic diagram of the pump and a value of the first pump operating parameter characteristic of the operational state of the pump, which is assigned to the predetermined value of the second pump operating parameter characteristic of the operational state of the pump on the set characteristic diagram of the pump may also be obtained. Once again, a progression over time of this difference may also be acquired, in order to obtain knowledge about the evolution over time of the operational state of the pump.

A point in time when a repair or an exchange of the pump will be required may be predicted on the basis of the progression over time of the difference between the value of the second pump operating parameter characteristic of the operational state of the pump, which is assigned to the predetermined value of the first pump operating parameter characteristic of the operational state of the pump on the actual characteristic diagram of the pump and the value of the second pump operating parameter characteristic of the operational state of the pump, which is assigned to the predetermined value of the first pump operating parameter characteristic of the operational state of the pump on the set characteristic diagram of the pump. This prediction may be created manually or in an automated manner. Based on this prediction, it is then possible to draw up maintenance schedules which interfere as little as possible with the operation of the higher-level system in which the pump is installed.

Alternatively or additionally to this, a point in time when a repair or an exchange of the pump will be required may also be predicted on the basis of the progression over time of the difference between the value of the first pump operating parameter characteristic of the operational state of the pump, which is assigned to the predetermined value of the second pump operating parameter characteristic of the operational state of the pump on the actual characteristic diagram of the pump and the value of the first pump operating parameter characteristic of the operational state of the pump, which is assigned to the predetermined value of the second pump operating parameter characteristic of the operational state of the pump on the set characteristic diagram of the pump.

A system according to the invention for monitoring the operational state of a pump comprises a device for acquiring a set characteristic diagram of the pump, the characteristic diagram of the pump being defined by a functional relationship between a first pump operating parameter characteristic of the operational state of the pump and a second pump operating parameter characteristic of the operational state of the pump. The device for acquiring a set characteristic diagram of the pump may comprise a storage unit which is designed to store a set characteristic diagram of the pump which is prescribed, for example, by a manufacturer of the pump. If necessary, however, the device for acquiring a set characteristic diagram of the pump may also comprise a suitable measuring device which is capable of measuring a functional relationship between the first and the second pump operating parameter. The measuring device may be a separate pump test stand, but also a measuring device which is installed together with the pump in a higher-level system or even partially or completely assigned to the higher-level system.

Furthermore, the system comprises a device for acquiring an actual characteristic diagram of the pump when the pump is installed in a higher-level system, in particular an aircraft system, and is running. The device for acquiring an actual characteristic diagram of the pump may also be employed to acquire the set characteristic diagram of the pump. The device for acquiring a set characteristic diagram of the pump is then not formed by a separate device, but by the device for acquiring an actual characteristic diagram of the pump.

Finally, the system according to the invention for monitoring the operational state of a pump comprises a device for comparing the actual characteristic diagram of the pump with the set characteristic diagram of the pump. This device may comprise, for example, a display which enables the output of a graphical representation of the set characteristic diagram and of the actual characteristic diagram of the pump. With the aid of the characteristic diagrams shown on the display, a manual characteristic diagram comparison may then be performed. The comparing device may, however, also be capable of carrying out an automatic set/actual characteristic diagram comparison and, for example, outputting a warning signal if the actual characteristic diagram deviates too much from the set characteristic diagram.

The device for acquiring a set characteristic diagram of the pump and/or the device for acquiring an actual characteristic diagram of the pump is/are preferably designed to define the characteristic diagram of the pump by a functional relationship between an outlet volume flow of the pump and an outlet pressure of the pump.

The device for acquiring a set characteristic diagram of the pump and/or the device for acquiring an actual characteristic diagram of the pump may comprise a flow sensor, in particular a non-invasive flow sensor, for acquiring the outlet volume flow of the pump. The flow sensor may be embodied as a non-invasive ultrasonic sensor. Furthermore, the device for acquiring a set characteristic diagram of the pump and/or the device for acquiring an actual characteristic diagram of the pump may comprise a pressure sensor for acquiring the outlet pressure of the pump. The pressure sensor is in particular a pressure sensor present in the higher-level system in which the pump is installed.

The device for comparing the actual characteristic diagram of the pump with the set characteristic diagram of the pump may be designed to compare the actual characteristic diagram of the pump with the set characteristic diagram of the pump, for at least one predetermined value of the first or of the second pump operating parameter characteristic of the operational state of the pump, the predetermined value of the first or of the second pump operating parameter characteristic of the operational state of the pump being characteristic of a standard operation of the pump or a high-load operation of the pump.

The device for comparing the actual characteristic diagram of the pump with the set characteristic diagram of the pump may be designed to obtain periodically or continuously, for at least one predetermined value of the first pump operating parameter characteristic of the operational state of the pump, a difference between a value of the second pump operating parameter characteristic of the operational state of the pump, which is assigned to the predetermined value of the first pump operating parameter characteristic of the operational state of the pump on the actual characteristic diagram of the pump and a value of the second pump operating parameter characteristic of the operational state of the pump, which is assigned to the predetermined value of the first pump operating parameter characteristic of the operational state of the pump on the set characteristic diagram of the pump. Furthermore, the device for comparing the actual characteristic of the pump with the set characteristic diagram of the pump may be designed to acquire a progression over time of this difference.

Alternatively or additionally to this, the device for comparing the actual characteristic of the pump with the set characteristic diagram of the pump may also be designed to obtain periodically or continuously, for at least one predetermined value of the second pump operating parameter characteristic of the operational state of the pump, a difference between a value of the first pump operating parameter characteristic of the operational state of the pump, which is assigned to the predetermined value of the second pump operating parameter characteristic of the operational state of the pump on the actual characteristic diagram of the pump and a value of the first pump operating parameter characteristic of the operational state of the pump, which is assigned to the predetermined value of the second pump operating parameter characteristic of the operational state of the pump on the set characteristic diagram of the pump. Once again, the device for comparing the actual characteristic diagram of the pump with the set characteristic diagram of the pump may also be designed to acquire a progression over time of this difference.

Furthermore, the device for comparing the actual characteristic diagram of the pump with the set characteristic diagram of the pump may be designed to predict a point in time when a repair or an exchange of the pump will be required on the basis of the progression over time of the difference between the value of the second pump operating parameter characteristic of the operational state of the pump, which is assigned to the predetermined value of the first pump operating parameter characteristic of the operational state of the pump on the actual characteristic diagram of the pump and the value of the second pump operating parameter characteristic of the operational state of the pump, which is assigned to the predetermined value of the first pump operating parameter characteristic of the operational state of the pump on the set characteristic diagram of the pump.

Alternatively or additionally to this, the device for comparing the actual characteristic diagram of the pump with the set characteristic diagram of the pump may also be designed to predict a point in time when a repair or an exchange of the pump will be required on the basis of the progression over time of the difference between the value of the first pump operating parameter characteristic of the operational state of the pump, which is assigned to the predetermined value of the second pump operating parameter characteristic of the operational state of the pump on the actual characteristic diagram of the pump and the value of the first pump operating parameter characteristic of the operational state of the pump, which is assigned to the predetermined value of the second pump operating parameter characteristic of the operational state of the pump on the set characteristic diagram of the pump.

The above-described method and/or the above-described system is/are usable particularly well for monitoring the operational state of a pump which is installed in an aircraft system, in particular a hydraulic system of an aircraft.

BRIEF DESCRIPTION OF THE DRAWINGS

A preferred embodiment of the invention will now be explained in more detail with the aid of the appended schematic drawings, of which

DETAILED DESCRIPTION OF THE PREFERRED EMBODIMENTS

Figure 2:
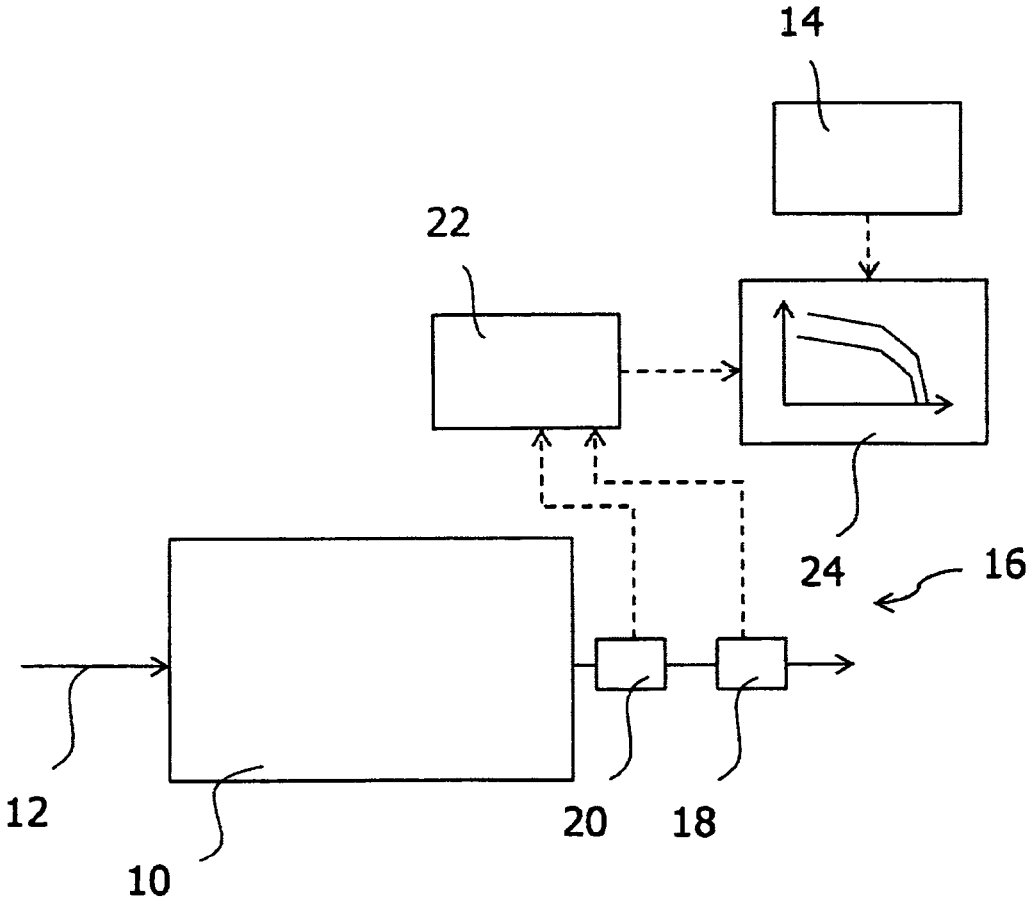
FIG. 2 shows a representation of a system for monitoring the operational state of a pump.

A method and a system for monitoring the operational state of a pump are explained below with reference to a pump 10 which is arranged in a hydraulic fluid line 12 of an aircraft hydraulic system and serves to convey hydraulic fluid through the hydraulic fluid line 12 of the aircraft hydraulic system, see FIG. 2. The pump 10 may be configured, for example, in the form of an axial piston pump. It is understood, however, that the method and the system for monitoring the operational state of a pump may also be realized with a different pump.

When the pump 10 is in a proper, intact operational state, internal leakages occur at various places inside the pump. These internal leakages are required for a proper operation of the pump 10, since they serve to lubricate and cool the pump 10. With increasing operating time of the pump 10, however, faults or wear phenomena lead to an excessive increase in the internal leakages, which have an adverse effect on the operational state, i.e., the operational reliability of the pump 10. The aim of the monitoring method and monitoring system described here is to monitor the operational state, i.e., the operational reliability of the pump 10 when the pump 10 is installed in the hydraulic system of the aircraft and is running, and thereby detect as early as possible reductions of the operational reliability of the pump 10.

Figure 1:
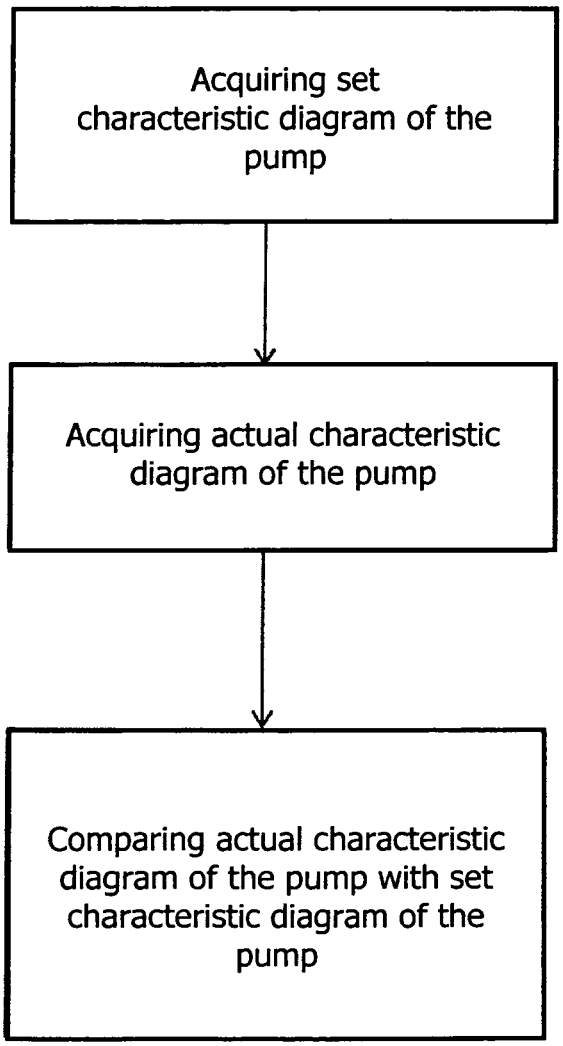
FIG. 1 shows a flow chart of a method for monitoring the operational state of a pump.

For this purpose, as illustrated in FIG. 1, in a first step a set characteristic diagram of the pump 10 is acquired first of all. The characteristic diagram of the pump 10 is defined by a functional relationship between two pump operating parameters characteristic of the operational state of the pump 10. The first pump operating parameter used here is an outlet volume flow of the pump 10 and the second pump operating parameter used here is an outlet pressure of the pump 10.

The set characteristic diagram of the pump 10 reflects the operating performance of the pump 10 when the pump 10 is intact, i.e., the set characteristic diagram indicates the set relationship between the outlet volume flow and the outlet pressure of the pump 10 in the intact, i.e., nominal operational state of the pump. A device 14 for acquiring the set characteristic diagram comprises a storage unit, in which the pairs of values of the outlet volume flow and the outlet pressure of the pump 10 which constitute the set characteristic diagram are stored. These pairs of values may be prescribed by the manufacturer of the pump 10 or ascertained from a maintenance manual or the like. Alternatively to this, the set characteristic diagram of the pump 10 may also be measured. In the embodiment discussed here, this is possible, for example, by measuring the outlet pressure of the pump 10 at a varying outlet volume flow of the pump. Such measurements may be carried out on a separate pump test stand when the pump 10 is not installed in the higher-level hydraulic system of the aircraft. Alternatively to this, however, it is also possible to utilize a device 16, explained in more detail below, for acquiring an actual characteristic diagram of the pump 10 also for acquiring the set characteristic diagram of the pump 10.

As already mentioned, a device 16 serves to acquire an actual characteristic diagram of the pump 10 when the pump 10 is installed in the higher-level hydraulic system of the aircraft and is running. The device 16 comprises a pressure sensor 18 which is arranged in the region of an outlet of the pump 10. The pressure sensor 18 may be a pressure sensor which is present anyway in the higher-level hydraulic system of the aircraft and serves, for example, to provide measurement data of the hydraulic fluid pressure in the hydraulic line 12 to a control unit (not shown in FIG. 2) for controlling the operation of the hydraulic system, which the control unit then uses to control the operation of the hydraulic system.

Furthermore, the device 16 comprises a flow sensor 20 which is likewise arranged in the region of the outlet of the pump 10. The flow sensor 20 is a non-invasive ultrasonic sensor which is permanently placed in the region of the outlet of the pump 10 and therefore enables a continuous measurement of the outlet volume flow of the pump 10. Measurement data acquired by the sensors 18, 20 when the pump 10 is running are supplied to an electronic control unit 22. The electronic control unit 22 creates an actual characteristic diagram of the pump 10 from these measurement data. A graphical representation of the set characteristic diagram and of the actual characteristic diagram of the pump 10 is output on a display 24. The electronic control unit 22 and the display 24 thus form a device for comparing the set characteristic diagram of the pump 10 with the actual characteristic diagram of the pump 10.

A set/actual characteristic diagram comparison may be carried out using the graphical representation of the set characteristic diagram and of the actual characteristic diagram of the pump 10 on the display 24. This set/actual characteristic diagram comparison enables conclusions to be drawn regarding the operational state, i.e., the operational reliability of the pump 10. This is explained in more detail below with reference to the graphical representation in FIG. 3.

Figure 3:
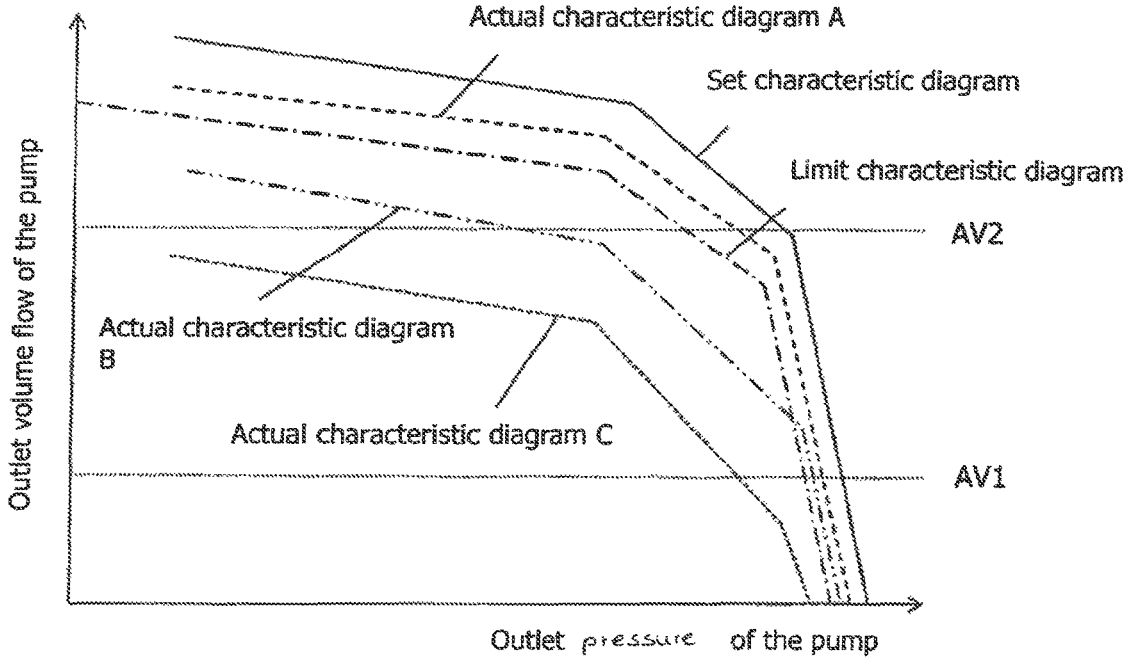
FIG. 3 shows a graphical representation of various characteristic diagrams of a pump.

In the graph according to FIG. 3, the set characteristic diagram of the pump 10 is shown as a continuous line. The dashed line in the representation according to FIG. 3 illustrates an actual characteristic diagram A of the pump 10 which results when the operational state of the pump 10 has deteriorated compared with the nominal operational state of the pump 10, but is still acceptable. This is apparent by the fact that the actual characteristic diagram A lies over its entire course above a limit characteristic diagram, marked by a dash-dot line, which specifies the limit between a characteristic diagram course which is still acceptable and one which is no longer acceptable. By contrast, the dash-double-dot line in FIG. 3 shows an actual characteristic diagram B of the pump 10 which already lies over part of its course below the limit characteristic diagram. Finally, an actual characteristic diagram C of the pump 10 which lies over its entire course below the limit characteristic diagram is shown by a dotted line.

If the actual characteristic diagram of the pump 10 lies over its entire course below the limit characteristic diagram, a repair or an exchange of the pump 10 is required. By contrast, if the actual characteristic diagram of the pump 10 lies only over part of its course below the limit characteristic diagram, a check can be done to see whether the pump 10 is operated frequently in an operating range in which the actual characteristic diagram lies below the limit characteristic diagram. If this is not the case and if the operating range of the pump 10 in which the actual characteristic diagram lies below the limit characteristic diagram is regarded as noncritical to the operation of the higher-level system in which the pump 10 is installed, the repair or the exchange of the pump 10 can optionally be postponed. Otherwise, a repair or an exchange of the pump 10 is necessary even if the actual characteristic diagram of the pump 10 lies only over part of its course below the limit characteristic diagram. In each case, however, a failure of the pump 10 and hence a failure of the higher-level system in which the pump 10 is installed is avoided.

In principle, it is possible manually, i.e., solely on the basis of the overview diagram according to FIG. 3, to assess the operational state of the pump 10 and to determine whether the pump 10 can continue to be operated or whether a repair or an exchange of the pump 10 is required. Alternatively or additionally to this, however, it is also possible to select one predetermined value or a plurality of predetermined values of one of the two pump operating parameters defining the pump characteristic diagram, and consequently a specific section of the pump characteristic diagrams, for the set/actual characteristic diagram comparison and thus the assessment of the operational state of the pump 10.

In the representation according to FIG. 3, a value AV1 of the outlet volume flow of the pump 10 represents a value of the outlet volume flow of the pump 10 which occurs in a frequently occurring standard operation of the pump 10 under normal load. By contrast, a value AV2 of the outlet volume flow of the pump 10 represents a value of the outlet volume flow of the pump 10 which occurs in a high-load operation of the pump 10. The operating performance of the pump 10 in the standard operation can be assessed by a set/actual characteristic diagram comparison for the value AV1. By contrast, a set/actual characteristic diagram comparison for the value AV2 enables an assessment of the operating performance of the pump 10 in the high-load operation. In particular, the actual characteristic diagram B in FIG. 3 shows that the operating performance of the pump 10 in the normal-load operation at AV1 may still be acceptable, whereas the operating performance of the pump 10 in the high-load operation at AV2 is no longer acceptable. This results from the fact that pump effects caused by wear or the like have a more pronounced effect in the high-load operation of the pump 10 than in the standard operation. A set/actual characteristic diagram comparison for the value AV2 therefore already provides early indications of slight deteriorations of the operational state of the pump 10.

Furthermore, for a predetermined value of the outlet volume flow of the pump 10 which may correspond, for example, to the value AV1 or the value AV2, it is possible to determine periodically or continuously a difference between a pump outlet pressure value assigned to this value of the outlet volume flow on the actual characteristic diagram and an outlet pressure value assigned to this value of the outlet volume flow of the pump 10 on the set characteristic diagram. From such a difference determination, it is possible to create the representation according to FIG. 4 which shows the evolution over time of the difference between actual outlet pressure value and set outlet pressure value at a predetermined outlet volume flow. As long as the difference is positive, the actual outlet pressure value lies above the set outlet pressure value, from which it can be derived that the operational state of the pump 10 corresponds to or is better than the nominal operational state. By contrast, if the difference between actual outlet pressure value and set outlet pressure value at the predetermined outlet volume flow becomes negative, this indicates that the operational state of the pump 10 no longer corresponds to the nominal operational state, i.e., that a relevant deterioration of the operational state of the pump 10 compared with the nominal operational state has occurred. If the difference between actual outlet pressure value and set outlet pressure value exceeds a specific threshold value $D_{crit}$, this can be judged to be an indication that the pump 10 must be repaired or exchanged.

Figure 4:
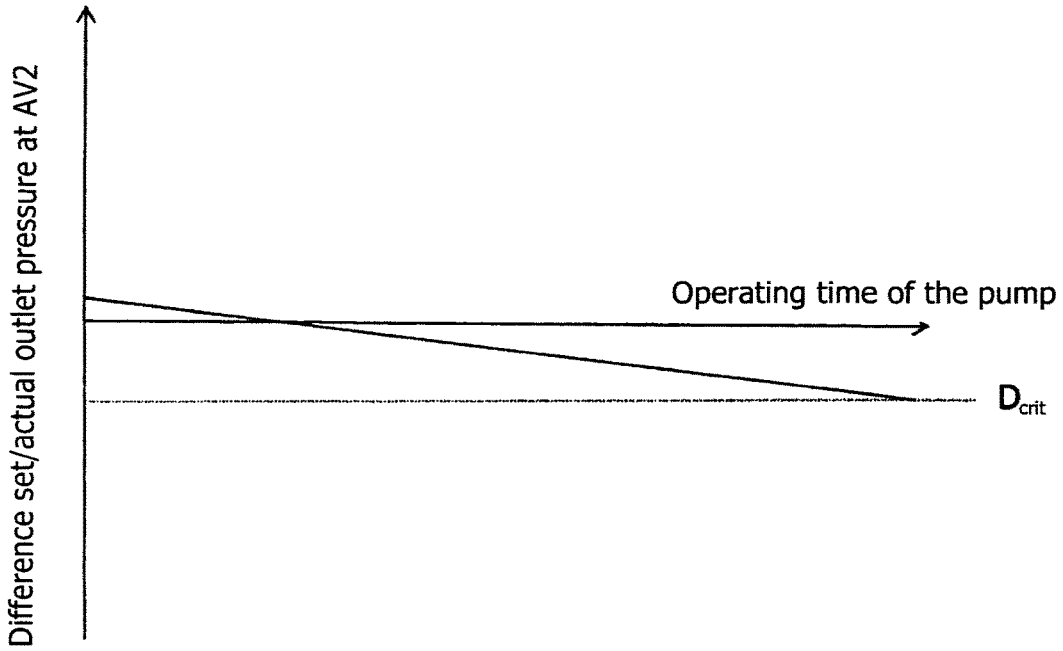
FIG. 4 shows a graphical representation of the result of a set/actual characteristic diagram comparison as a function of time.

The representation according to FIG. 4 may, however, also be used, even before the threshold value $D_{crit}$ has been reached, to predict a point in time when a repair or an exchange of the pump 10 will be required. In particular, the course of the curve in FIG. 4 allows conclusions to be drawn regarding the speed with which the deterioration of the operational state of the pump 10 is occurring. The representations according to FIGS. 3 and 4 are created by the control unit 22 in the system illustrated in FIG. 2 and output on the display 24.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A method for monitoring the operational state of a pump comprising the steps:

acquiring a set characteristic diagram of the pump, the characteristic diagram of the pump being defined by a functional relationship between a first pump operating parameter characteristic of the operational state of the pump and a second pump operating parameter characteristic of the operational state of the pump, acquiring an actual characteristic diagram of the pump when the pump is installed in a higher-level system of an aircraft, and is running, and comparing the actual characteristic diagram of the pump with the set characteristic diagram of the pump, the method including a further step of at least one of:

one of periodically or continuously, for at least one predetermined value of the first pump operating parameter characteristic of the operational state of the pump, acquiring a difference between:

a value of the second pump operating parameter characteristic of the operational state of the pump, which is assigned to the predetermined value of the first pump operating parameter characteristic of the operational state of the sums on the actual characteristic diagram of the pump and a value of the second pump operating parameter characteristic of the operational state of the pump, which is assigned to the predetermined value of the first pump operating parameter characteristic of the operational state of the pump on the set characteristic diagram of the pump, and also acquiring a progression over time of this difference, or one of periodically or continuously, for at least one predetermined value of the second pump operating parameter characteristic of the operational state of the pump, acquiring a difference between:

a value of the first pump operating parameter characteristic of the operational state of the pump, which is assigned to the predetermined value of the second pump operating parameter characteristic of the operational state of the pump on the actual characteristic diagram of the pump, and a value of the first pump operating parameter characteristic of the operational state of the pump, which is assigned to the predetermined value of the second pump operating parameter characteristic of the operational state of the pump on the set characteristic diagram of the pump and also acquiring a progression over time of this difference.

2. The method according to claim 1, wherein the characteristic diagram of the pump is defined by a functional relationship between an outlet volume flow of the pump and an outlet pressure of the pump.

3. The method according to claim 2, wherein at least one of the outlet volume flow of the pump is acquired by a flow sensor, and the outlet pressure of the pump is acquired by a pressure sensor.

4. The method according to claim 3, wherein the flow sensor comprises a non-invasive ultrasonic sensor.

5. The method according to claim 3, wherein the pressure sensor is located in the higher-level system.

6. The method according to claim 1, wherein the actual characteristic diagram of the pump is compared with the set characteristic diagram of the pump for at least one predetermined value of one of the first and the second pump operating parameter characteristics of the operational state of the pump, the predetermined value of the one of the first and the second pump operating parameter characteristics of the operational state of the pump being characteristic of one of a standard operation of the pump and a high-load operation of the pump.

7. The method according to claim 1, including a further step of at least one of:

predicting a point in time when a repair or an exchange of the pump will be required on the basis of the progression over time of the difference between the value of the second pump operating parameter characteristic of the operational state of the pump, which is assigned to the predetermined value of the first pump operating parameter characteristic of the operational state of the pump on the actual characteristic diagram of the pump and the value of the second pump operating parameter characteristic of the operational state of the pump, which is assigned to the predetermined value of the first pump operating parameter characteristic of the operational state of the pump on the set characteristic diagram of the pump, and predicting a point in time when a repair or an exchange of the pump will be required on the basis of the progression over time of the difference between the value of the first pump operating parameter characteristic of the operational state of the pump, which is assigned to the predetermined value of the second pump operating parameter characteristic of the operational state of the pump on the actual characteristic diagram of the pump and the value of the first pump operating parameter characteristic of the operational state of the pump, which is assigned to the predetermined value of the second pump operating parameter characteristic of the operational state of the pump on the set characteristic diagram of the pump.

8. The method according to claim 1 used for monitoring the operational state of a pump which is installed in a hydraulic system of the aircraft.

9. A system for monitoring the operational state of a pump comprising:

a device for acquiring a set characteristic diagram of the pump, the characteristic diagram of the pump being defined by a functional relationship between a first pump operating parameter characteristic of the operational state of the pump and a second pump operating parameter characteristic of the operational state of the pump, a device for acquiring an actual characteristic diagram of the pump when the pump is installed in a higher-level system of an aircraft, and is running, and a device for comparing the actual characteristic diagram of the pump with the set characteristic diagram of the pump, wherein the device for comparing the actual characteristic diagram of the pump with the set characteristic diagram of the pump is configured to at least one of:

obtain, one of periodically or continuously, for at least one predetermined value of the first pump operating parameter characteristic of the operational state of the pump, a difference between a value of the second pump operating parameter characteristic of the operational state of the pump, which is assigned to the predetermined value of the first pump operating parameter characteristic of the operational state of the pump on the actual characteristic diagram of the pump and a value of the second pump operating parameter characteristic of the operational state of the pump, which is assigned to the predetermined value of the first pump operating parameter characteristic of the operational state of the pump on the set characteristic diagram of the pump, and also acquiring a progression over time of this difference, and obtain, one of periodically or continuously, for at least one predetermined value of the second pump operating parameter characteristic of the operational state of the pump a difference between a value of the first pump operating parameter characteristic of the operational state of the pump, which is assigned to the predetermined value of the second pump operating parameter characteristic of the operational state of the pump on the actual characteristic diagram of the pump and a value of the first pump operating parameter characteristic of the operational state of the pump, which is assigned to the predetermined value of the second pump operating parameter characteristic of the operational state of the pump on the desired characteristic diagram of the pump, and also acquiring a progression over time of this difference.

10. The system according to claim 9, wherein at least one of the device for acquiring a set characteristic diagram of the pump and the device for acquiring an actual characteristic diagram of the pump is designed to define the characteristic diagram of the pump by a functional relationship between an outlet volume flow of the pump and an outlet pressure of the pump.

11. The system according to claim 10, wherein at least one of at least one of the device for acquiring a set characteristic diagram of the pump and the device for acquiring an actual characteristic diagram of the pump, comprises a flow sensor for acquiring the outlet volume flow of the pump, and at least one of the device for acquiring a set characteristic diagram of the pump and the device for acquiring an actual characteristic diagram of the pump, comprises a pressure sensor for acquiring the outlet pressure of the pump.

12. The system according to claim 11, wherein the flow sensor comprises a non-invasive ultrasonic sensor.

13. The system according to claim 11, wherein the pressure sensor is located in the higher-level system.

14. The system according to claim 9, wherein the device for comparing the actual characteristic diagram of the pump with the set characteristic diagram of the pump is designed to compare the actual characteristic diagram of the pump with the set characteristic diagram of the pump, for at least one predetermined value of one of the first and second pump operating parameter characteristic of the operational state of the pump, the predetermined value of the one of the first and second pump operating parameter characteristic of the operational state of the pump being characteristic of one of a standard operation of the pump and a high-load operation of the pump.

15. The system according to claim 9, wherein at least one of the device for comparing the actual characteristic diagram of the pump with the set characteristic diagram of the pump is designed to predict a point in time when a repair or an exchange of the pump will be required on the basis of the progression over time of the difference between the value of the second pump operating parameter characteristic of the operational state of the pump, which is assigned to the predetermined value of the first pump operating parameter characteristic of the operational state of the pump on the actual characteristic diagram of the pump and the value of the second pump operating parameter characteristic of the operational state of the pump, which is assigned to the predetermined value of the first pump operating parameter characteristic of the operational state of the pump on the set characteristic diagram of the pump, or the device for comparing the actual characteristic diagram of the pump with the set characteristic diagram of the pump is designed to predict a point in time when a repair or an exchange of the pump will be required on the basis of the progression over time of the difference between the value of the first pump operating parameter characteristic of the operational state of the pump, which is assigned to the predetermined value of the second pump operating parameter characteristic of the operational state of the pump on the actual characteristic diagram of the pump and the value of the first pump operating parameter characteristic of the operational state of the pump, which is assigned to the predetermined value of the second pump operating parameter characteristic of the operational state of the pump on the set characteristic diagram of the pump.

16. The system of claim 9 arranged to monitor the operational state of a pump in a hydraulic system of the aircraft.

* * * * *